US008656821B2

(12) United States Patent
White et al.

(10) Patent No.: US 8,656,821 B2
(45) **Date of Patent: *Feb. 25, 2014**

(54) DEFENSIVE PANEL ACCESS PORT

(71) Applicant: Defenshield, Inc., East Syracuse, NY (US)

(72) Inventors: William Collins White, Cicero, NY (US); John Kleniatis, Jamesville, NY (US); Matthew McAllister, Columbia, SC (US)

(73) Assignee: Defenshield, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/764,863

(22) Filed: Feb. 12, 2013

(65) Prior Publication Data

US 2014/0013935 A1 Jan. 16, 2014

Related U.S. Application Data

(63) Continuation of application No. 12/354,304, filed on Jan. 15, 2009, now Pat. No. 8,397,618.

(60) Provisional application No. 61/021,077, filed on Jan. 15, 2008.

(51) Int. Cl.
*F41H 5/02* (2006.01)
*E04B 1/92* (2006.01)

(52) U.S. Cl.
USPC ..... 89/36.01; 89/36.14; 89/918; 89/936; 52/741.3

(58) Field of Classification Search
USPC ..... 89/36.01, 36.03, 36.04, 36.14; 109/11, 109/16, 49.5, 58.5; 27/15, 31; 222/557; 52/202, 741.3
See application file for complete search history.

(56) References Cited

U.S. PATENT DOCUMENTS 1,203,291 A 10/1916 White
1,212,463 A 1/1917 Doran
(Continued)

FOREIGN PATENT DOCUMENTS

CA 1105324 7/1981
DE 7826689 2/1979
(Continued)

OTHER PUBLICATIONS

International Patent Application No. PCT/US2010/030588 International Search Report dated Feb. 17, 2011, 17 pages.
(Continued)

*Primary Examiner* — Bret Hayes
(74) *Attorney, Agent, or Firm* — Baker & Hostetler LLP

(57) ABSTRACT

A threat resistant access port is disclosed, including a resistant panel having an access aperture formed therein. A resistant cover is movably coupled to the panel, the cover being pivotally slideable relative to the panel so as to cover the aperture in a closed position and to uncover the aperture in an open position. The resistant cover comprises an outer member, the outer member being threat resistant and located proximate an outer side of the panel. The resistant cover further comprises an inner member, the inner member coupled to the outer member and located proximate an inner side of the panel opposite the outer side of the panel.

32 Claims, 7 Drawing Sheets

(56) References Cited

U.S. PATENT DOCUMENTS

| | | | |
|---|---|---|---|
| 1,730,781 | A | 10/1929 | Manis |
| 1,847,419 | A | 3/1932 | Wise |
| 2,430,059 | A | 11/1947 | Krantz |
| 3,213,810 | A | 10/1965 | Powers, Jr. |
| 3,262,227 | A | 7/1966 | Pentecost |
| 3,453,929 | A | 7/1969 | Betzold et al. |
| 3,762,345 | A | 10/1973 | Sgariglia, Jr. |
| 3,774,363 | A | 11/1973 | Kent |
| 3,933,346 | A | 1/1976 | Carver |
| 3,968,809 | A | 7/1976 | Beavers |
| 4,112,645 | A | 9/1978 | Greenfield |
| 4,245,566 | A | 1/1981 | Shimansky et al. |
| 4,351,247 | A | 9/1982 | Clark |
| 4,430,831 | A | 2/1984 | Kemp |
| 4,434,579 | A | 3/1984 | Murphy |
| 4,454,691 | A | 6/1984 | Mitchell |
| 4,630,411 | A | 12/1986 | Salzer |
| 4,771,673 | A | 9/1988 | Miller |
| 4,785,969 | A | 11/1988 | Mclaughlin |
| 4,856,575 | A | 8/1989 | Wells |
| 4,878,314 | A | 11/1989 | Blockinger |
| 4,991,369 | A | 2/1991 | Lamb |
| 5,012,610 | A | 5/1991 | Carballo |
| 5,046,284 | A | 9/1991 | Harper |
| 5,052,850 | A | 10/1991 | Bishop |
| 5,165,189 | A | 11/1992 | Besal |
| 5,174,553 | A | 12/1992 | Challis |
| 5,242,207 | A | 9/1993 | Carson et al. |
| 5,271,311 | A | 12/1993 | Madden, Jr. |
| 5,497,588 | A | 3/1996 | Martin et al. |
| 5,529,366 | A | 6/1996 | Gold |
| 5,594,193 | A | 1/1997 | Sheridan |
| 5,603,190 | A | 2/1997 | Sanford |
| 5,644,881 | A | 7/1997 | Neilly |
| 5,657,590 | A | 8/1997 | Digman et al. |
| 5,666,773 | A | 9/1997 | Librande et al. |
| 5,765,325 | A | 6/1998 | DeBlock |
| 5,857,730 | A | 1/1999 | Korpi et al. |
| 5,906,070 | A | 5/1999 | Boerhave |
| 5,907,929 | A | 6/1999 | Poma et al. |
| 5,986,211 | A | 11/1999 | Greer et al. |
| D431,082 | S | 9/2000 | Jaros |
| 6,230,455 | B1 | 5/2001 | Arehart et al. |
| 6,302,010 | B1 | 10/2001 | Holler |
| 6,551,011 | B1 | 4/2003 | Valentine |
| 6,581,668 | B1 | 6/2003 | Oakley |
| 6,622,607 | B1 | 9/2003 | Miller |
| 6,626,314 | B1 | 9/2003 | McHenry et al. |
| 6,694,683 | B2 | 2/2004 | Anderson et al. |
| 6,698,690 | B2 | 3/2004 | Novak et al. |
| 6,907,811 | B2 | 6/2005 | White |
| 6,931,810 | B2 | 8/2005 | Beaudoin et al. |
| 6,964,131 | B2 | 11/2005 | Herrmann et al. |
| 7,040,062 | B2 | 5/2006 | Emek |
| 7,063,374 | B1 | 6/2006 | Cameron |
| 7,080,874 | B2 | 7/2006 | Farrar |
| 7,107,736 | B2 | 9/2006 | Barnard |
| 7,165,364 | B2 | 1/2007 | Inelli |
| 7,232,181 | B2 | 6/2007 | Schmucker |
| 7,789,010 | B2 | 9/2010 | Allor et al. |
| 7,823,498 | B2 | 11/2010 | Schneider et al. |
| 8,015,910 | B1 | 9/2011 | Fuqua et al. |
| 8,291,657 | B2 | 10/2012 | White |
| 8,397,618 | B2 * | 3/2013 | White et al. ..... 89/36.01 |
| 2002/0095885 | A1 | 7/2002 | Sampson |
| 2002/0184839 | A1 | 12/2002 | Emek |
| 2004/0058125 | A1 | 3/2004 | Gonzalez |
| 2004/0211133 | A1 | 10/2004 | Berger |
| 2004/0216593 | A1 | 11/2004 | Pastrnak |
| 2005/0055906 | A1 | 3/2005 | Barnard |
| 2005/0072073 | A1 | 4/2005 | Inelli |
| 2005/0138872 | A1 | 6/2005 | Farrar et al. |
| 2005/0238880 | A1 | 10/2005 | Labock |
| 2006/0005481 | A1 | 1/2006 | Ouellette |
| 2006/0254947 | A1 | 11/2006 | Rogers |
| 2007/0000189 | A1 | 1/2007 | Chang |
| 2007/0011962 | A1 | 1/2007 | Erskine |
| 2007/0180981 | A1 | 8/2007 | Tapp |
| 2007/0193213 | A1 | 8/2007 | Nanayakkara |
| 2007/0243015 | A1 | 10/2007 | Yodock, III et al. |
| 2007/0296229 | A1 | 12/2007 | Chauvin et al. |
| 2008/0016799 | A1 | 1/2008 | Sayer |
| 2008/0092731 | A1 | 4/2008 | Hall |
| 2008/0271652 | A1 | 11/2008 | White et al. |
| 2009/0277094 | A1 | 11/2009 | Ward |
| 2009/0277109 | A1 | 11/2009 | Taylor et al. |
| 2009/0277110 | A1 | 11/2009 | Cashman |
| 2010/0242714 | A1 | 9/2010 | Piscitelli et al. |
| 2010/0251635 | A1 | 10/2010 | Barnard et al. |

FOREIGN PATENT DOCUMENTS

| | | |
|---|---|---|
| EP | 292274 | 11/1988 |
| FR | 2701996 | 9/1994 |
| FR | 2848599 | 6/2004 |
| JP | 06058055 | 3/1994 |
| WO | WO 2009/020681 | 2/2009 |
| WO | WO 2009/091887 | 7/2009 |
| WO | WO 2011/002538 | 1/2011 |

OTHER PUBLICATIONS

International Patent Application No. PCT/US2008/062690 International Search Report dated Mar. 12, 2009, 4 pages.

U.S. Appl. No. 12/354,304: non-final office action, dated Apr. 20, 2012.

International Patent Application No. PCT/US10/31097: International Search Report and Written Opinion dated Mar. 17, 2009, 1 page.

* cited by examiner

DEFENSIVE PANEL ACCESS PORT

CROSS REFERENCE TO RELATED APPLICATIONS

This application in a continuation of U.S. patent application Ser. No. 12/354,304, filed Jan. 15, 2009 which claims priority to provisional U.S. patent application No. 61/021,077, filed Jan. 15, 2008, the contents of which are incorporated herein by reference in their entirety.

TECHNICAL FIELD

The present application relates to defensive barriers, and more particularly, to barriers for resisting ballistics, blasts, and other threats.

BACKGROUND

Law enforcement, security personnel, armed forces, and others are regularly placed in threatening environments. For example, security personnel may be the target of fire arms, mortars, and blasts. In hostile environments, threat resistant barriers such as those disclosed in U.S. Pat. No. 6,907,811, the contents of which are hereby incorporated by reference in its entirety, are often deployed. Threat resistant barriers provide protection for security personnel by deflecting projectiles, ballistics, and blasts.

SUMMARY

Applicants disclose a threat resistant access port that may be used, for example, with defensive barriers. The threat resistant access port provides a secured port for gaining access from one side of a threat resistant panel to another. In an exemplary embodiment, the threat resistant access port includes a resistant panel having an access aperture formed therein. A resistant cover is movably coupled to the panel and is pivotally slideable relative to the panel so as to cover the aperture in a closed position and to uncover the aperture in an open position. The resistant cover may include an outer member and an inner member. The outer member may be threat resistant, i.e., resistant to ballistics, mortar, blasts, etc., and located proximate an outer side of the panel. The inner member is coupled to the outer member and located proximate an inner side of the panel opposite the outer side of the panel.

Applicants disclose a method for assembling a threat resistant access port. In an exemplary embodiment, a resistant panel having an access aperture formed therein is provided. This may involve, for example, creating an access aperture in the resistant panel. Thereafter, a resistant cover as described above is pivotally coupled to the resistant panel. The resistant cover is pivotally slideable relative to the panel so as to cover the aperture in a closed position and to uncover the aperture in an open position.

Applicants also disclose a threat resistant temporary fortification assembly which is adapted for use in creating temporary fortifications such as, for example, foxholes, defensive trenches, and/or sandbag or earthen fortifications. In an exemplary embodiment, the temporary fortification assembly comprises a resistant panel including a sensing aperture adapted for providing access to sensing information between sides of the resistant panel. For example, the sensory aperture may provide for visual or heat sensory access between sides of the panel. A resistant sensory pane adapted for providing access to and/or gathering sensory information is positioned over at least a portion of the sensing aperture. In an exemplary embodiment, the resistant sensory pane may be, for example, a transparent pane that allows for visual inspection through the pane. A sensory pane frame is removably mounted to the resistant panel and secures the resistant sensory pane in a position over at least a portion of the sensing aperture.

A method for creating a threat resistant temporary fortification comprises providing a threat resistant temporary fortification assembly and filling material adjacent to the temporary fortification assembly.

Applicants still further disclose a threat barrier that includes at least one resistant panel and at least one threat resistant access port. The access port includes an access aperture formed in the at least one panel and a resistant cover movably coupled to the panel, the cover being pivotally slideable relative to the panel so as to cover the aperture in a closed position and to uncover the aperture in an open position. The resistant cover includes an outer member, the outer member being threat resistant and located proximate an outer side of the panel and an inner member. The inner member is coupled to the outer member and located proximate an inner side of the panel opposite the outer side of the panel.

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter. Other features are described below.

DETAILED DESCRIPTION OF ILLUSTRATIVE EMBODIMENTS

Exemplary Access Port

Figure 1A:
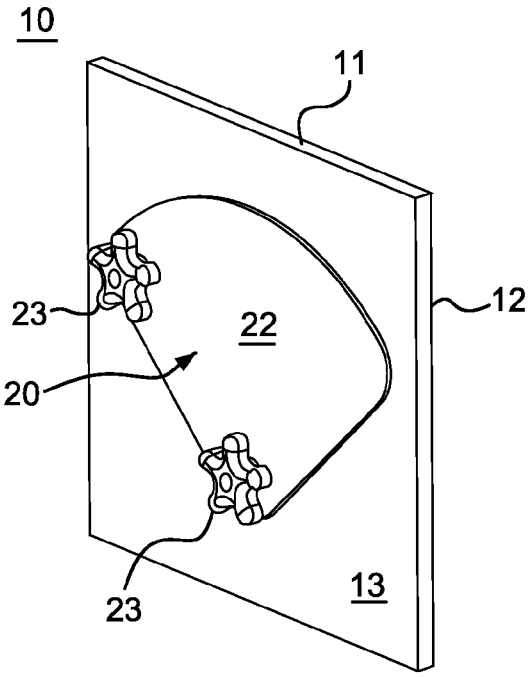
FIG. 1A is a perspective view of the inner side of an access port in a closed position.
Figure 1B:
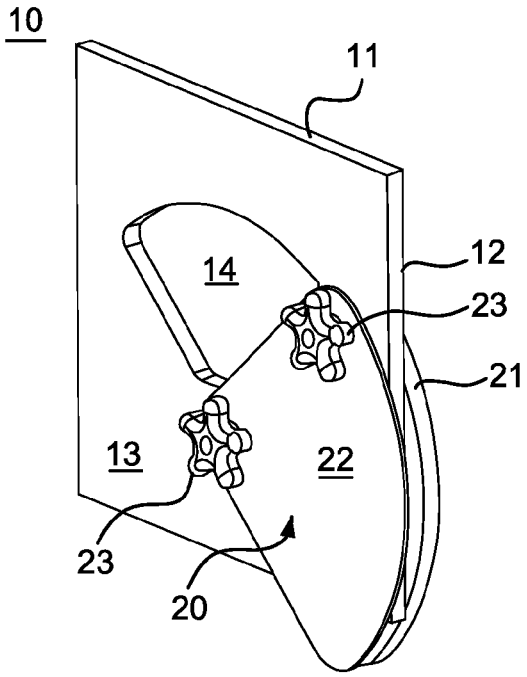
FIG. 1B is a perspective view of the inner side of the access port depicted in FIG. 1A, shown in an open position.
Figure 1C:
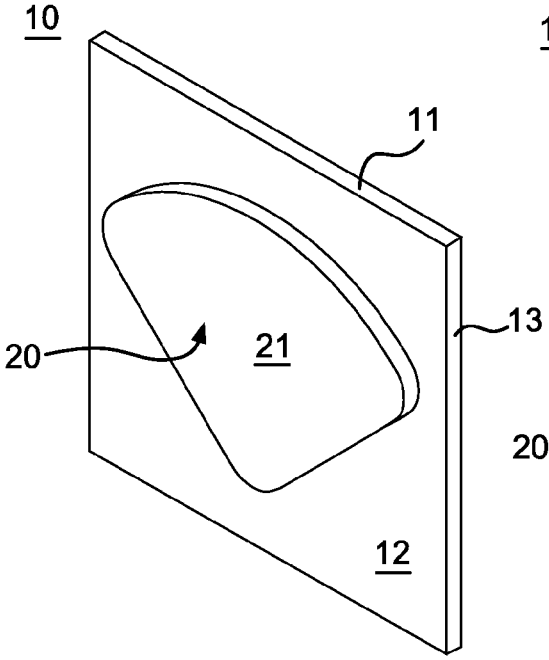
FIG. 1C is a perspective view of the outer side of the access port depicted in FIG. 1A, shown in a closed position.
Figure 1D:
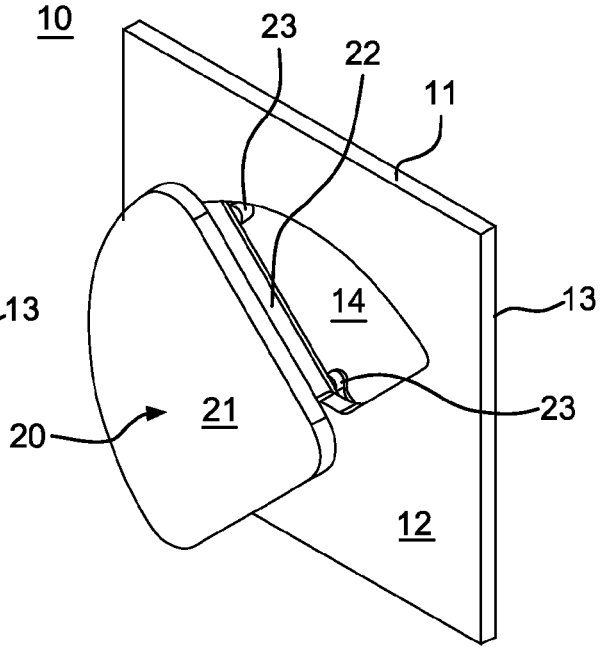
FIG. 1D is a perspective view of the outer side of the access port depicted in FIG. 1A, shown in an open position.

FIGS. 1A-1D illustrate an exemplary access port 10. As illustrated, an exemplary access port 10 includes a threat resistant panel 11 and a threat resistant cover 20 that is pivotally slideable relative to the panel 11. The panel 11 defines an outer side 12, an inner side 13 opposite the outer side 12, and an access aperture 14 formed therein. The resistant cover 20 is movably coupled to the panel 11 and includes an outer member 21 located proximate the outer side 12, an inner member 22 located proximate the inner side 13, and resistance devices 23 for selectively adjusting resistance between the cover 20 and the panel 11.

The threat resistant panel 11 may serve to protect people or property positioned behind the inner side 13 of the panel 11 from harmful effects of explosion blasts and related shock waves, incoming ammunition, and projectiles such as bullets, missiles, rockets, or any other ballistics or safety threats known in the art. The threat resistant panel 11 may serve to resist, deflect or alter the trajectory of, and/or provide a point of impact to detonate any or all such incoming ballistics and/or resist explosive blast shock waves. The threat resistant panel 11 and all other threat resistant elements discussed herein may be opaque, translucent, or transparent, and may be made from any explosive blast or ballistic resistant material, such as steel, glass, ceramic, Kevlar, fiberglass, a composite material, or any other material that meets standards that are known in the art for ballistic or explosive blast resistance.

The access aperture 14 may be used to allow a user (not shown) of the resistant panel 11 to view or access the area outside the outer side 12 of the panel 11. For example, a user may: fire ballistics at an enemy or other target through the access aperture 14; insert the tip of a gun or other weapon through the access aperture 14 to threaten an enemy; or use the access aperture 14 for any other purpose, such as viewing the area outside the outer side 12, passing light and/or sound waves through the access aperture 14 (e.g., shining a spot light to view something outside the outer side 12, communicating to someone via voice or megaphone, etc.), and/or passing objects through the access aperture 14. In an exemplary embodiment, the access aperture 14 has a semicircular shape but may have any suitable shape and/or configuration. The size of the access aperture 14 may be any that is suitable for the particular application.

The resistant cover 20 is adapted to selectively cover the access aperture 14. The resistant cover 20 may be selectively pivoted to a fully closed position (shown, for example, in FIGS. 1A and 1C), a fully open position (shown, for example, in FIGS. 1B and 1D), or any intermediate position (i.e., the cover 20 partially covers the panel 11) in a continuous spectrum between a fully closed position and a fully open position. The resistant cover 20 may be clamped or fixed in a desired position by tightening the resistance devices 23, which tighten the outer member 21 and the inner member 22 against the panel 11. The resistant cover 20 may also include features (not shown) that may assist a user in moving the resistant cover 20 to predetermined discrete positions, such as ¼-open or ½-open. For example, one of the resistant panel 11 or the resistant cover 20 may include flexible protrusions (not shown) at predetermined discrete positions that are configured to fit into grooves or slots (not shown) at predetermined discrete positions in the other of the resistant cover 20 or the resistant panel 11.

The outer member 21 of the resistant cover 20 may be opaque, translucent, or transparent, and may be made from any threat resistant material, such as steel, glass, ceramic, Kevlar, fiberglass, a composite material, or any other material that meets standards that are known in the art for explosive blast and/or ballistic resistance. The outer member 21 may be large enough to cover the entire area of the access aperture 14, thereby protecting the user from ballistics or any other threatening items that may attempt to penetrate through the access aperture 14.

As shown in the Figures, the surface area of the outer member 21 is slightly larger than the cross-sectional area of the access aperture 14, which may allow the outer member 21 to be clamped to the panel 11 by tightening of the resistance devices 23 (e.g., adjustment knobs). The tightening of the outer member 21 to the panel 11 may create sufficient friction between the outer member 21 and the outer side 12 for the cover 20 to maintain any desired position relative to the access aperture 14 (e.g., an open position, an intermediate position, or a closed position). In an exemplary embodiment, the access panel has a semicircular shape but may have any shape that is suitable for the particular embodiment.

The inner member 22 is adapted to brace the outer member 21 to the panel 11. The inner member 22 of the resistant cover 20 may be opaque, translucent, or transparent, and may be made from any resistant material (such as steel or any of the resistant materials mentioned above) or any non-resistant material, such as aluminum, plastic, carbon fiber, or any composite material. The inner member 22 may be large enough to cover the entire area of the access aperture 14, or the inner member 22 may cover a portion of the access aperture 14.

Although the inner member 22 is shown in the figures as solid and having substantially the same shape as the outer member 21, the inner member 22 may have any shape. For example, the inner member 22 may comprise a box, a ring, an arc, or any other shape. The inner member 22 may be solid or include an open space in the center of the inner member 22. For example, the inner member 22 may comprise a lattice pattern, including holes between portions of the lattice, or the inner member 22 may comprise any other shape that includes holes, gaps, slots, or other apertures.

Although the outer member 21 and the inner member 22 are shown herein as single-layer panels, the outer member 21 and the inner member 22 may each be made of two or more panels of the same or different materials. For example, the outer member 21 and/or the inner member 22 may include a gasket (not shown) made of rubber or another deformable material to help create a better seal between the outer member 21 and the panel 11 and/or the inner member 22 and the panel 11, and the outer member 21 and/or the inner member 22 may include an additional layer (not shown) of plastic or Teflon to allow the outer member 21 and/or the inner member 22 to slide more easily against the respective outer side 12 or inner side 13 of the panel 11 as the resistant cover 20 moves between the closed position, any intermediate positions, and the open position.

Figure 2A:
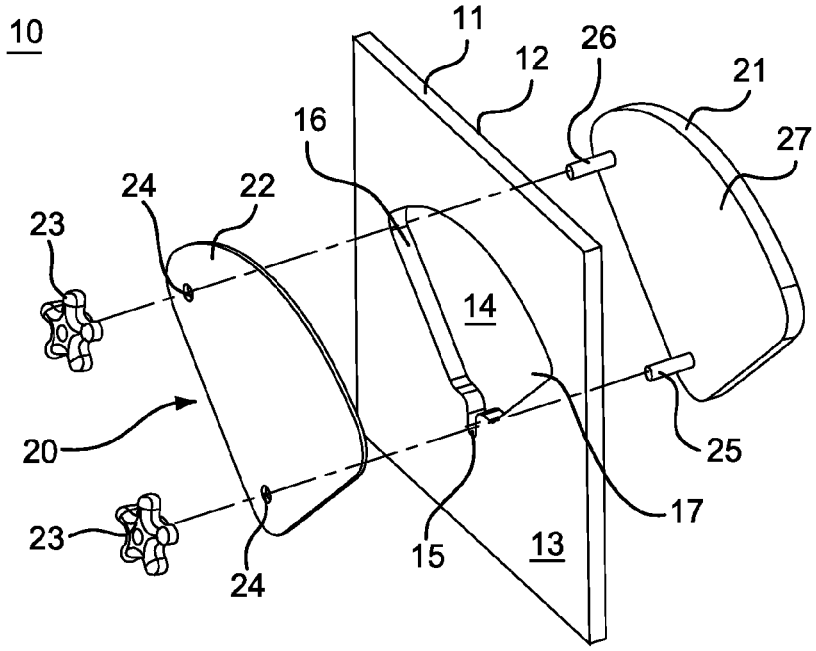
FIG. 2A is an exploded perspective view of the inner side of the access port depicted in FIG. 1A, shown in a closed position.
Figure 2B:
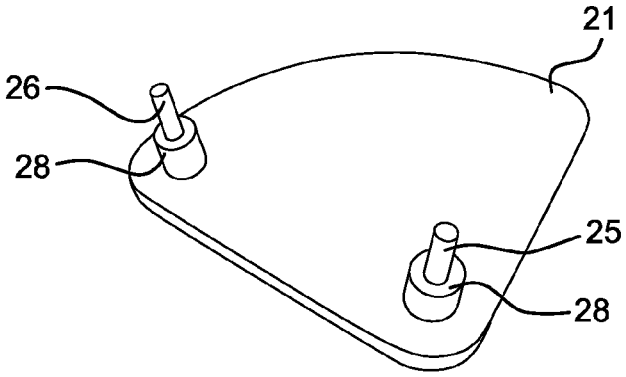
FIG. 2B is a perspective view of the outer member of the resistant cover depicted in FIG. 2A.
Figure 2C:
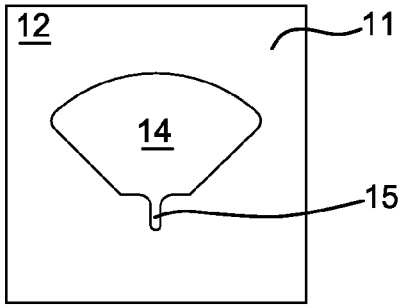
FIG. 2C is a plan view of the outer side of the resistant panel depicted in FIG. 2A.

Referring now to FIGS. 2A-2C, the resistant cover 20 may be coupled to the resistant panel 11 by disposing the outer member 21 proximate the outer side 12 of the panel 11, disposing the inner member 22 proximate the inner side 13, and coupling the outer member 21 to the inner member 22 by inserting a pivot member 25 and a connector 26 into holes 24 and tightening the resistance devices or fasteners 23 onto the pivot member 25 and the connector 26.

The resistance devices 23 help to couple the resistant cover 20 to the resistant panel 11 by coupling the outer member 21 to the inner member 22. The resistance devices 23 are mounted on the pivot member 25 and the connector 26 abutting the inner member 22 and are adapted to selectively adjust resistance between the inner member 22 and the outer member 21 and the panel 11.

As shown in the Figures, the resistance devices 23 are tapped adjustment knobs that may be screwed onto threaded portions of the pivot member 25 and the connector 26. In the embodiment shown, the resistance devices 23 may be installed and removed without the use of tools, thereby allowing the resistant cover 20 to be manually installed to and removed from the resistant panel 11 without the use of tools. In embodiments where the access aperture 14 is substantially symmetrical (e.g., as shown in FIG. 2A) a user or manufacturer may choose to install the outer member 21 of the resistant cover 20 on either the outer side 12 of the panel 11 or the inner side 13 of the panel 11. In such embodiments, the resistant cover 20 is reversible, depending on the requirements of the user. The location of the outer member relative to the outer side 12 or the inner side 13 of the panel 11 may be changed by the user by removing the resistance devices 23 from the pivot member 25 and the connector 26, reinstalling the outer member 21 on the desired side 12 or 13 of the panel 11, and replacing the resistance devices 23 back onto the pivot member 25 and the connector 26.

In other embodiments, the resistance devices or fasteners 23 may be any other devices or fasteners that are capable of selectively providing a clamping or fastening force between the resistant cover 20 and the resistant panel 11, including devices that permit manual installation and removal of cover 20 with or without the use of tools. For example, the resistance devices or fasteners 23 may be wing nuts, standard nuts, a ratcheting mechanism, cotter pins, hinged portions of the pivot member 25 and the connector 26, or any other clamping or fastening mechanism that is known in the art.

As shown in the Figures, the pivot member 25 and the connector 26 extend from an inner surface 27 of the outer member 21 in a direction substantially transverse to the inner surface 27. In an exemplary embodiment, the pivot member 25 and the connector 26 may be stud-welded to the inner surface 27 of the outer member 21, without penetrating through the outer member 21. In other embodiments, the pivot member 25 and the connector 26 may penetrate through the outer member 21 or may be affixed to the outer member 21 using any attachment mechanism known in the art.

In the exemplary embodiment of FIG. 2A, the resistant cover 20 includes a single pivot member 25 and a single connector 26. In other embodiments (not shown), there may be a plurality of pivot members 25 and/or connectors 26. For example, there may be a row (not shown) of connectors 26 extending along an edge of the outer member 21, each connector 26 extending through a corresponding hole 24 in the inner member 22, and each connector 26 may be coupled to a respective resistance device 23 to allow the cover 20 to be clamped against the panel 11.

When the resistant cover 20 is installed into the resistant panel 11, the pivot member 25 is seated into a pivot notch 15 in the access aperture 14. As shown in the Figures, the pivot notch 15 is integrated into the access aperture 14. In other embodiments (not shown), the pivot notch 15 may be a separate hole or slot, penetrating through the panel 11 at a location that is separate from the access aperture 14. While not being bound by a particular theory of operation, it is believed that a manufacturer may more easily cut the access aperture 14 in the panel 11 using non-precision machinery or methods (e.g., a plasma cut) when the pivot notch 15 is integrated into the access aperture 14 in a single continuous aperture.

The resistant cover 20 pivots about the pivot member 25 to move or slide between the closed position, any intermediate positions, and the open position. As shown in the Figures, the resistant cover 20 pivots about the pivot member 25 without the use of a hinge or a spring-based device. In other embodiments (not shown), a hinge that may provide tension to resist or aid rotation of the resistant cover 20 as it pivots may be included in the pivot member 25. The connector 26 may help to secure the relative angular position of the outer member 21 to the inner member 22, and the connector 26 may contact a far edge 17 when the cover 20 reaches the open position, providing a stop mechanism for the pivoting rotation of the cover 20 when the cover 20 reaches the open position.

In an exemplary embodiment, in a closed position, the resistant cover 20 substantially covers the access aperture 14 and the connector 26 contacts a near edge 16 of the access aperture 14. In an intermediate position, the cover 20 partially covers the access aperture 14 and the connector 26 does not contact the near edge 16 or far edge 17 of the access aperture 14. In the open position, the cover 20 may cover none of or a small portion of the access aperture 14 and the connector 26 contacts the far edge 17 of the access aperture 14.

In an exemplary embodiment, the resistant cover 20 is biased toward the closed position by gravity when the cover 20 is near the closed position (i.e., when the center of gravity of the cover 20 is on a first side of a vertical axis intersecting the pivot member 25) and the cover 20 is biased toward the open position by gravity when the cover 20 is near the open position (i.e., when the center of gravity of the cover 20 is on a second side of a vertical axis intersecting the pivot member 25).

In an exemplary embodiment, the resistant cover 20 includes an outer member 21 and an inner member 22 that each generally have a pie wedge shape, and the pivot member 25 is located near the vertex of the pie wedge. In the illustrative embodiment, the wedge shape of the outer member 21 and the inner member 22 covers an approximately 90-degree arc. In an exemplary embodiment, and while not being bound by theory, the use of a pie wedge shape covering less than a 180-degree arc and having a pivot member 25 located near the vertex of the pie wedge for the outer member 21 may allow the resistant cover 20 to be relatively easily pivoted by a user between the open position, any intermediate position, and the closed position.

As shown in the Figures, the access aperture 14 generally has a pie wedge shape, sized slightly smaller than the pie wedge shape of the cover 20. In an exemplary embodiment, and not being bound by theory, the presence of an overlap of the outer member 21 and the inner member 22 onto the panel 11 (outside the boundaries of the access aperture 14) may ensure the ability of the cover 20 to completely cover the access aperture 14 and may provide improved structural rigidity and/or improved impact strength of the cover 20 when the cover 20 is in the closed position.

In other embodiments using a general pie wedge shape for the outer member 21, the inner member 22 and the access aperture 14, the pie wedge shape may cover an arc of any size, for example, between 1 degree and 180 degrees, preferably between 15 degrees and 135 degrees, more preferably between 30 and 120 degrees. The exact shape and size of the outer member 21, the inner member 22, and the access aperture 14 may be chosen based on the anticipated use of the access port 10. For example, if the access port 10 will be used for the tip of a rifle, a pie wedge shape of approximately 30 degrees may be sufficient for the user.

In some embodiments (not shown), the outer member 21, the inner member 22, and the access aperture 14 may have any symmetric or asymmetric shape, including a circle, oval, square, rectangle, crescent, an asymmetric pie wedge (see, for example, FIG. 3C) or any other symmetric or asymmetric shape. In some embodiments (not shown), the outer member 21, the inner member 22, and the access aperture 14 may each have shapes that are different from each other, or the outer member 21, the inner member 22, and the access aperture 14 may each have pie wedge shapes that cover arcs of different degrees from each other.

Referring specifically to FIG. 2B, the resistant cover 20 may include one or more bushings 28. In the embodiment shown in FIG. 2B, a bushing 28 surrounds a portion of the pivot member 25 and a portion of the connector 26 closest to the inner surface 27 of the outer member 21. The bushings 28 are adapted to absorb forces created during the impact of the connector 26 with the edges 16 and 17 of the aperture 14 and during the impact of the pivot member 25 with edges of the access aperture 14 when the cover 20 is moved between open and closed positions. In the embodiment shown, each bushing 28 forms an interference fit with the respective pivot member 25 and the connector 26. In other embodiments, each bushing 28 may be more loosely fit over the pivot member 25 and/or the connector 26, and each bushing 28 may be glued to the respective pivot member 25 and/or the connector 26, or any other attachment mechanism known in the art may be used to couple each bushing 28 to the pivot member 25 and the connector 26. While not being bound by a particular theory of operation, the presence of the bushings 28 surrounding a portion of the pivot member 25 and a portion of the connector 26 may allow for greater manufacturing tolerances during the manufacturing and assembly of the resistant cover 20 and/or the access aperture 14. For example, a bushing 28 of a greater diameter may be used to surround a portion of the pivot member 25 if the pivot notch 15 in the access aperture 14 is cut wider due to non-precision manufacturing tolerance variation.

In potential embodiments, there may be no bushing 28 on the pivot member 25 and/or the connector 26. In other embodiments, each bushing 28 may surround the entire length of the pivot member 25 and/or the connector 26. In an exemplary embodiment, the bushing 28 may be made of rubber. In other embodiments, the bushing 28 may be made of plastic, Teflon, carbon fiber, a composite material, or any other material known in the art that may absorb or dissipate energy and/or help to protect the edges of the access aperture 14 and the pivot member 25 and the connector 26 from wear and damage during use.

Figure 3A:
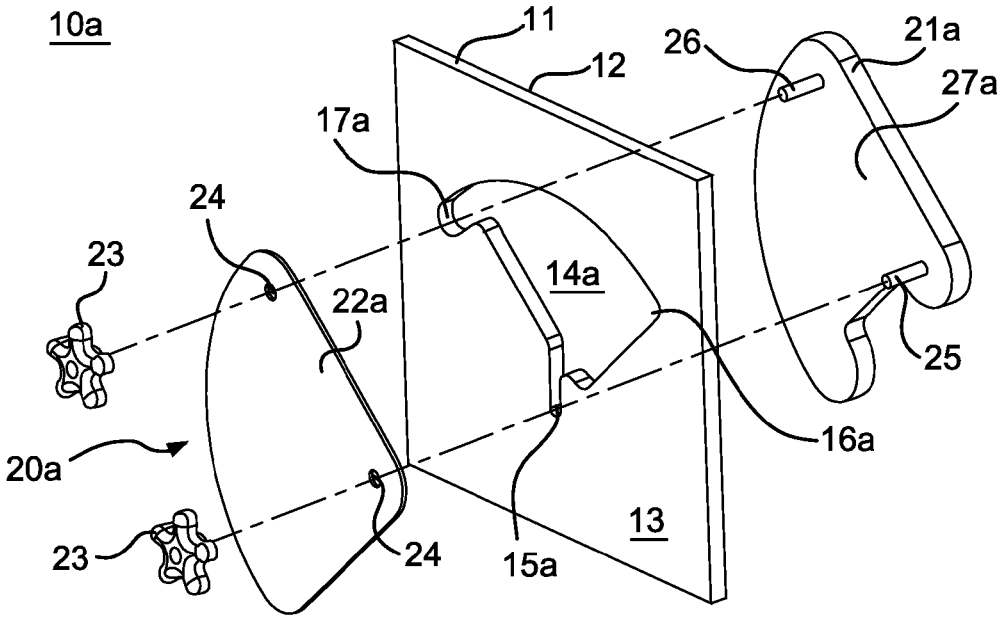
FIG. 3A is an exploded perspective view of the inner side of an alternate embodiment of an access port.
Figure 3B:
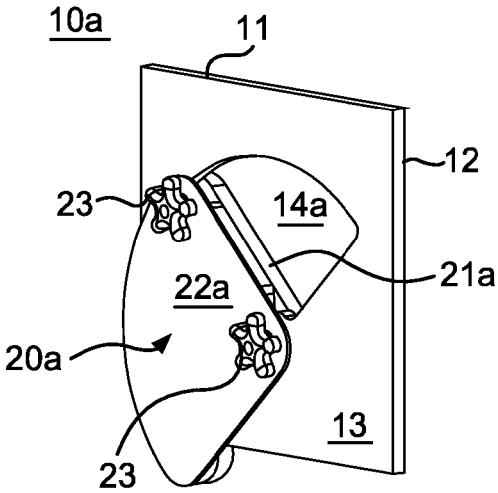
FIG. 3B is a perspective view of the inner side of the access port depicted in FIG. 3A, shown in an open position.
Figure 3C:
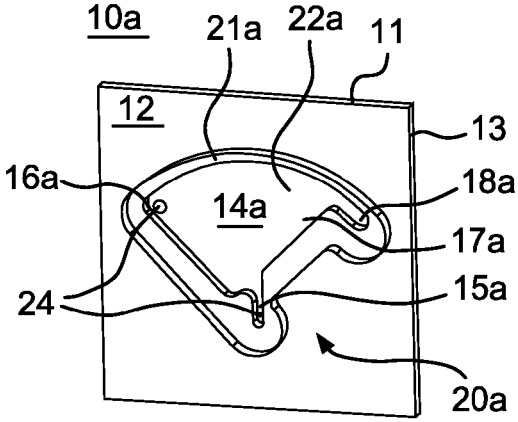
FIG. 3C is a perspective view of the outer side of the access port depicted in FIG. 3A, shown in a closed position, with the outer member of the resistant cover shown in translucent form for illustrative purposes.

Referring now to FIGS. 3A-3C, an alternate embodiment access port 10*a* includes an asymmetrical access aperture 14*a* and an asymmetrical outer member 21*a* of a threat resistant cover 20*a*. As shown in FIG. 3C, the threat resistant cover 20*a* includes an outer member 21*a* and an inner member 22*a* that each generally have a pie wedge shape, except for the far edge 17*a* of the outer member 21*a* of the resistant cover 20*a*, the far edge 17*a* extending between a pivot notch 15*a* and a far notch 18*a*.

The resistant cover 20*a* pivots about a pivot member 25 that is seated into the pivot notch 15*a* in the access aperture 14*a*. The resistant cover 20*a* pivots around the pivot member to move or slide between the closed position, any intermediate positions, and the open position. A connector 26 may help to secure the relative angular position of the outer member 21*a* to the inner member 22*a*, and the connector 26 may contact a far notch 18*a* when the cover 20*a* reaches the open position, providing a stop mechanism for the pivoting rotation of the cover 20*a* when the cover 20*a* reaches the open position.

The use of a pie wedge shape of the access aperture 14*a* having a far notch 18*a* may allow the resistant cover 20*a* to be more stably secured by a user when the cover 20*a* is disposed in the open position, because the connector 26 may be more securely seated in the far notch 18*a* when the cover 20*a* is disposed in the open position. While not being bound by theory, the use of a pie wedge shape of the outer member 21*a* of the resistant cover 20*a* may help to reduce the weight of the resistant cover 20*a* for an access aperture 14*a* of a given size, which may allow a user to more easily open and close the cover 20*a*.

Exemplary Temporary Fortification Assembly

Figure 4A:
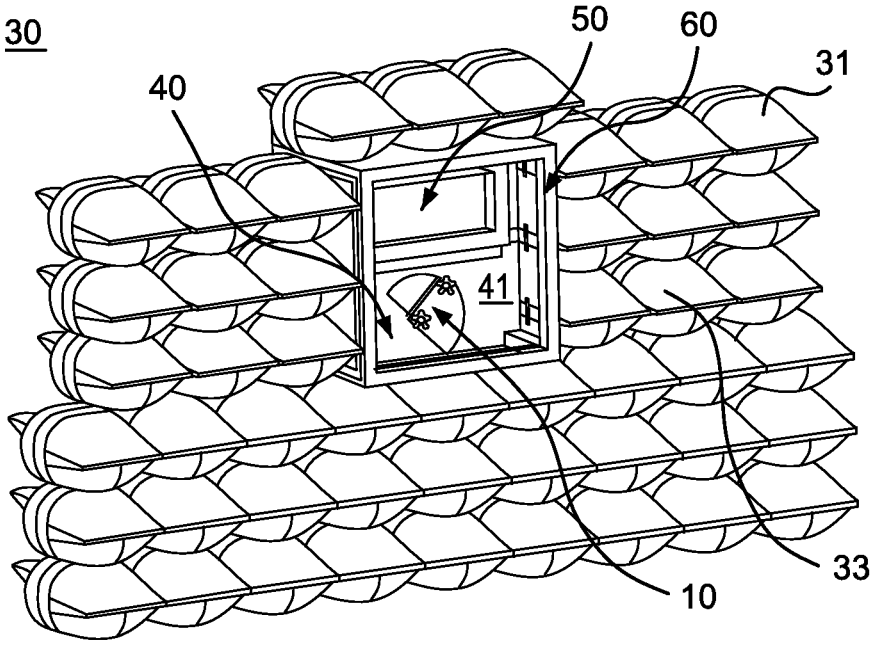
FIG. 4A is a perspective view of an inner side of a temporary fortification assembly surrounded by filling material.
Figure 4B:
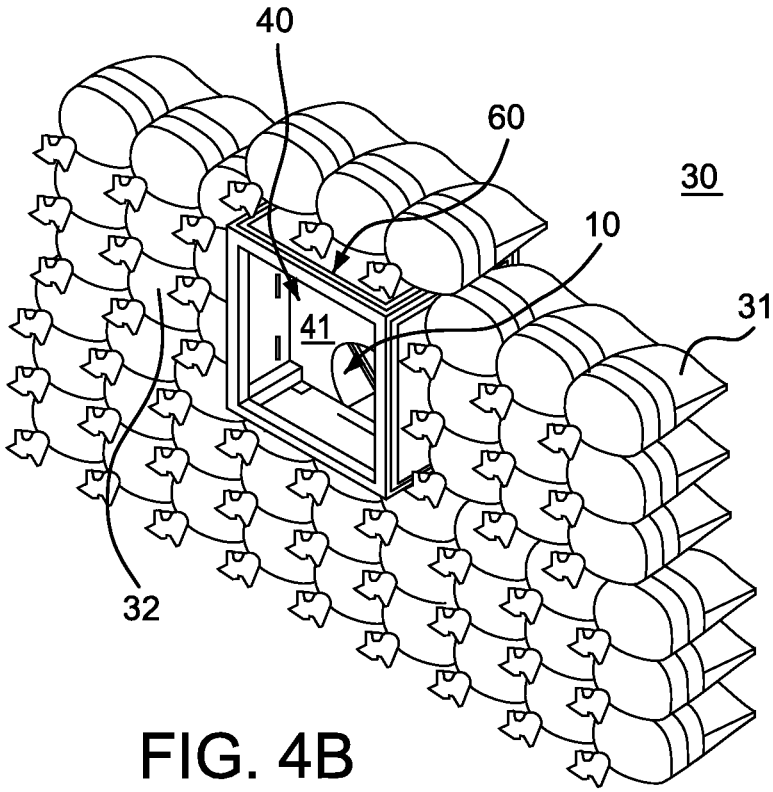
FIG. 4B is a perspective view of an outer side of the temporary fortification assembly depicted in FIG. 4A surrounded by filling material.

Applicants also disclose a temporary fortification assembly 40 adapted to be used in creating temporary fortifications. For example, the temporary fortification assembly 40 may be used in creating a temporary fortification such as, for example, foxholes, defensive trenches, and/or sandbag or earthen fortifications. Referring to FIGS. 4A and 4B, a temporary fortification assembly 40 is used in creating a temporary fortification 30 by disposing a filling material 31 around the temporary fortification assembly 40 to define an outer side 32 and an inner side 33 of the fortification 30. The temporary fortification 30 may serve to protect people or property positioned behind the inner side 33 of the temporary fortification 30 from harmful effects of explosion blasts and related shock waves, incoming ammunition, and projectiles such as bullets, missiles, rockets, or any other ballistics or safety threats known in the art.

The filling material 31 may serve to resist, deflect or alter the trajectory of, and/or provide a point of impact to detonate any or all such incoming ballistics and/or resist explosive blast shock waves. The filling material 31 may include one or more of sand, dirt, earth, or any other material suitable for temporary fortification that is known in the art, disposed substantially adjacent to the temporary fortification assembly 40. In the Figures shown, the filling material 31 is enclosed inside of bags to allow a user to more easily build the temporary fortification 30. However, in some embodiments (not shown), the filing material 31 is used without bags to construct the temporary fortification 30.

In an exemplary embodiment, the temporary fortification assembly 40 includes a threat resistant panel 41, an access port 10 movably coupled to the panel 41 as described above and as shown in FIGS. 1A-2C, a sensory pane assembly 50 that allows visual (e.g., a visually transparent window pane), heat, acoustic, or other spectral phenomena access through the panel 41, and a frame assembly 60 that is adapted to support the filling material 31. As used herein, the term "sensory pane" means a pane that allows visual (e.g., a visually transparent window pane), heat, acoustic, or other spectral phenomena access through the surface of the pane.

The temporary fortification assembly 40 may serve to resist, deflect or alter the trajectory of, and/or provide a point of impact to detonate any or all such incoming ballistics. The temporary fortification assembly 40 may include threat resistant components (e.g., panel 41 and sensory pane 51 shown in FIGS. 5A-5C) that are opaque, translucent, or transparent, and may be made from any explosive blast or ballistic resistant material, such as steel, glass, ceramic, Kevlar, fiberglass, a composite material, or any other suitable material.

In the illustrated exemplary embodiment, the temporary fortification assembly 40 has a generally square shape. In other potential embodiments (not shown), the temporary fortification assembly 40 may have other shapes, including rectangular, triangle, trapezoid, hexagon, circle, oval, or any other shape, depending on the desired field of view or other sensing through the resistant sensory pane 51 and ease of view and/or access through the access port 10.

The temporary fortification assembly 40 may be used to allow a user (not shown) of the temporary fortification 30 to view, sense, and/or access the area outside the outer side 32 of the temporary fortification 30. Using the access port 10, a user may: fire ballistics at an enemy or other target through the access port 10; insert the tip of a gun or other weapon through the access port 10 to threaten an enemy; or use the access port 10 for any other purpose, such as viewing the area outside the outer side 32, passing light and/or sound waves through the access port 10 (e.g., shining a spot light to view something outside the outer side 32, communicating to someone via voice or megaphone, etc.), and/or passing objects through the access port 10.

In addition to using the access port 10 to view the area outside the outer side 32 of the temporary fortification 30, a user may view or sense heat or other spectral phenomena in the area outside the outer side 32 through the sensory pane assembly 50, and, for example, a user may pass light waves through the sensory pane assembly 50 (e.g., shining a spot light to view something outside the outer side 32) to more easily view the area outside the outer side 32.

In an exemplary embodiment, the sensory pane assembly 50 is mounted to the temporary fortification assembly 40 on the inner side 33 of the temporary fortification 30. In other embodiments, the sensory pane assembly 50 may be mounted on the outer side 32 of the temporary fortification 30. While not being bound by a particular theory, in embodiments where the sensory pane assembly 50 is mounted on the outer side 32 of the temporary fortification 30, it is believed that the temporary fortification assembly 40 may be more resistant to damage from explosive blasts and any associated shock waves, thereby increasing the ability of the temporary fortification 30 to provide protection for the user or other property on the inner side 33.

The frame assembly 60 may be adapted to support the filling material 31. As shown in the Figures, the box-like structure of the frame assembly 60 may allow a user to easily integrate the temporary fortification assembly 40 into the temporary fortification 30 by placing the filling material 31 or bags of the filling material 31 adjacent to the frame assembly 60. The frame assembly 60 may prevent the filling material 31 from obstructing the ability of the user to view, sense, and/or access the area outside the outer side 32 of the temporary fortification 30 by supporting the filling material 31 away from the sensory pane assembly 50 and the access port 10.

Figure 5A:
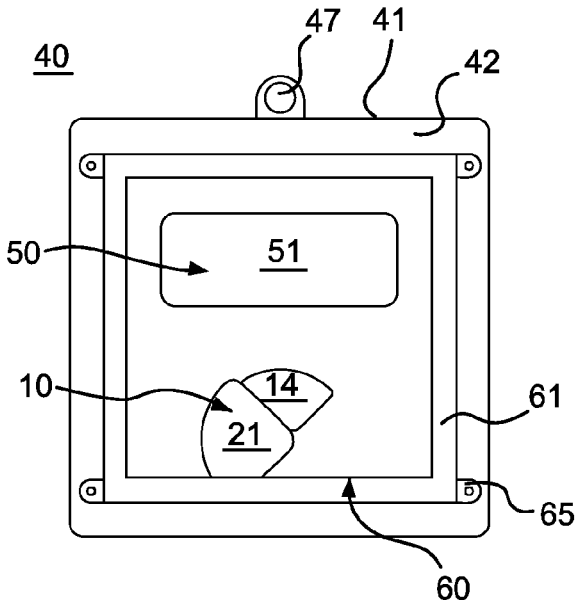
FIG. 5A is a plan view of the outer side of the temporary fortification assembly depicted in FIG. 4A.
Figure 5B:
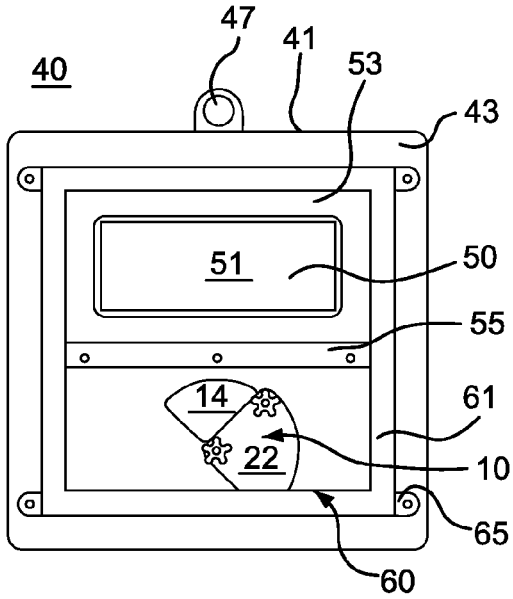
FIG. 5B is a plan view of the inner side of the temporary fortification assembly depicted in FIG. 5A.
Figure 5C:
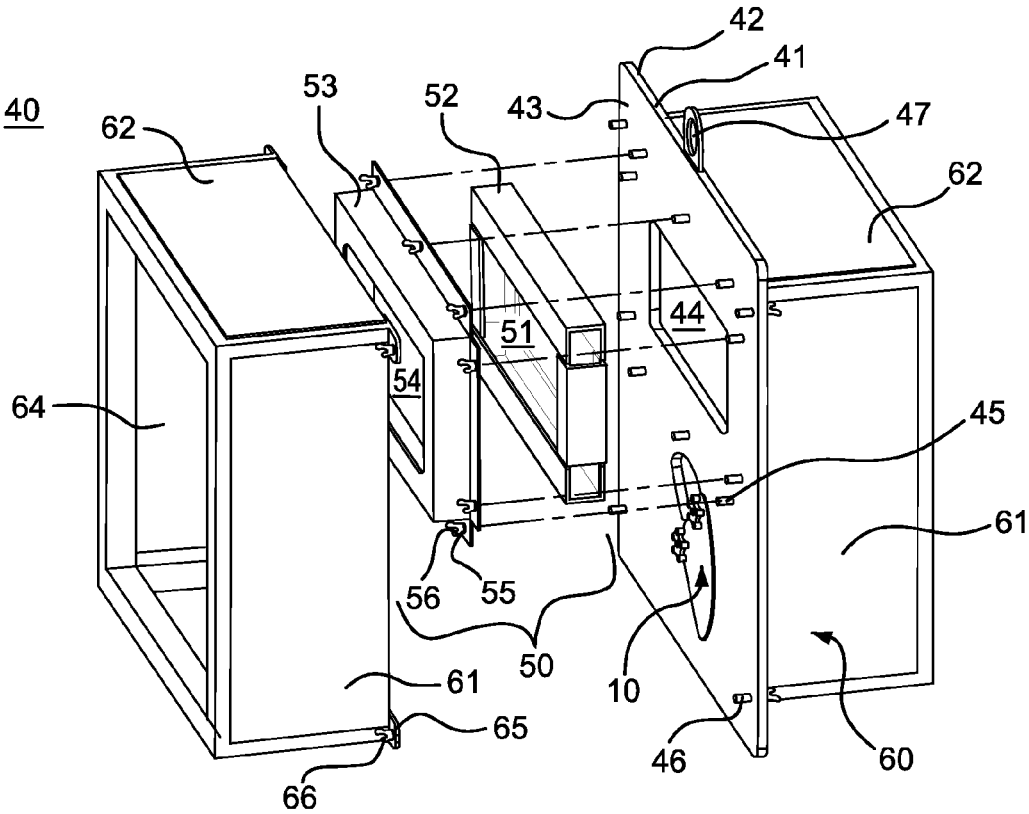
FIG. 5C is an exploded perspective view of the inner side of the temporary fortification assembly depicted in FIG. 4A.

Referring now to FIGS. 5A-5C, in an exemplary embodiment, the threat resistant panel 41 defines an outer side 42 and an inner side 43 opposite the outer side 42. The panel 41 has a sensing aperture 44 formed therein adapted for allowing sensing of activities on the outer side 42 of the panel 41. A plurality of sensory pane frame coupling members 45 extend from the panel 41 and are adapted for use in coupling a sensory pane frame 53 to the panel 41. A plurality of frame coupling members 46 extend from the panel 41 and are adapted for use in coupling a support assemblies 61 to the panel 41. A handle, lifting point, or lifting structure 47 extends from the top of the panel 41 and is adapted to facilitate handling of the panel 41.

The sensory pane assembly 50 includes a threat resistant sensory pane 51, a gasket 52 surrounded the resistant sensory pane 51, and a sensory pane frame 53 defining a sensory pane frame aperture 54. The sensory pane frame 53 is adapted to couple the sensory pane 51 to the panel 41. Holes 55 and resistance devices or fasteners 56 are adapted for coupling the sensory pane frame 53 to the threat resistant panel 41.

In an exemplary embodiment, the resistant sensory pane 51 is translucent or transparent. In other embodiments (not shown), the resistant sensory pane 51 may be partially opaque, including, for example, a lattice structure combining strips of resistant steel and a pane of resistant glass. Threat resistant sensory pane 51 may include any combination of opaque, translucent, or transparent materials that permit a user to have some visual, heat, acoustic, light, or other spectral phenomena access to the outer side 32 of the temporary fortification 30. For example, the resistant sensory pane 51 may be made from one or more of steel, glass, ceramic, Kevlar, fiberglass, a composite material, or any other material that is suitable.

In an exemplary embodiment, the resistant sensory pane 51 is rectangular. In other embodiments (not shown), the resistant sensory pane 51 may have other shapes, including square, triangle, trapezoid, hexagon, circle, oval, or any other shape, depending on the desired field of view or sensing through the resistant sensory pane 51.

In an exemplary embodiment, the resistant sensory pane 51 is positioned over the sensing aperture 44, covering all of the sensing aperture 44. In an exemplary embodiment, the resistant sensory pane 51 is sized slightly larger than the rectangular shape of the sensing aperture 44. In other embodiments (not shown), the sensory pane 51 may have a generally different shape than the sensing aperture 44, and the sensory pane 51 may be positioned over at least a portion of the sensing aperture 44.

While not being bound by theory, the presence of an overlap of the resistant sensory pane 51 beyond the sensing aperture 44 in the resistant panel 41 (outside the boundaries of the sensing aperture 44) may ensure the ability of the cover resistant sensory pane 51 to completely cover the sensing aperture 44 and may provide improved structural rigidity and/or improved impact strength of the resistant sensory pane 51.

The sensory pane frame 53 is adapted to secure the resistant sensory pane 51 in a position over the sensing aperture 44 in the resistant panel 41. The resistant sensory pane 51 may be mounted at least partially inside of the sensory pane frame 53, where the sensory pane frame 53 may abut the resistant sensory pane 51. The sensory pane frame 53 may be made from any ballistic-resistant or non-ballistic-resistant material, including steel, aluminum, carbon fiber, a composite material, or any other material suitable for mounting the sensory pane 51 to the resistant panel 41.

In one embodiment, the sensory pane frame 53 may be adapted to secure the sensory pane 51 over at least a portion of the sensing aperture 44, while the sensory pane frame 53 may be positioned over the remaining portion of the sensing aperture 44 that is not covered by the sensory pane 51. In such embodiments, the sensory pane frame 53 may be directly exposed to the outer side 32 of the temporary fortification 30, and the sensory pane frame 53 may be made from a resistant material (e.g., any resistant material described above). The sensory pane 51 is directly exposed to the outer side 32 of the temporary fortification assembly 40 through the sensory pane frame aperture 54.

In an exemplary embodiment, the gasket 52 surrounds the sensory pane 51. The gasket 52 may help to protect the sensory pane 51 from damage or wear from contacting the sensory pane frame 53. In embodiments where the sensory pane 51 is made from a first material (e.g., glass), and the sensory pane frame 53 is made from a second material (e.g., steel), the two materials having different thermal coefficients of expansion, the use of a gasket 52 made from a compressible material (e.g., rubber or any other compressible material suitable for gaskets that is known in the art) may be able to help maintain a seal between the sensory pane 51 and the sensory pane frame 53 during a variety of temperature conditions. In one embodiment (not shown), the sensory pane 51 may be placed directly inside of the sensory pane frame 53 without the use of a gasket 52.

The sensory pane frame 53 is mounted to the resistant panel 41 by coupling the resistance devices 56 to the plurality of sensory pane frame coupling members 45 that extend in a substantially transverse direction from the panel 41, through the holes 55 in the sensory pane frame 53. The resistance devices 56 are adapted to selectively adjust resistance between the sensory pane frame 53 and the inner side 43 of the resistant panel 41. As shown in the Figures, the sensory pane frame 53 is removably mounted to the resistant panel 41. In other embodiments (not shown), the sensory pane frame 53 may be permanently mounted to the resistant panel 41 (e.g., mounted with the use of welding). In such embodiments where the sensory pane frame 53 is permanently mounted to the resistant panel 41, the sensory pane frame 53 may include a channel (not shown) cut out of or formed in the top of the sensory pane frame 53 in which the sensory pane 51 may be inserted into position over the sensing aperture 44.

In an exemplary embodiment, the resistance devices 56 are tapped wing nuts that may be screwed onto threaded portions of the sensory pane frame coupling members 45. In the embodiment shown, the resistance devices 56 may be installed and removed without the use of tools, thereby allowing the sensory pane frame 53 and the resistant sensory pane 51 to be manually installed to and removed from the resistant panel 41 without the use of tools.

In embodiments where the sensory pane frame 53 and the resistant sensory pane 51 are mounted on the inner side 43 of the resistant panel 41, the sensory pane frame 53 and the resistant sensory pane 51 may be manually installed to and removed from the resistant panel 41 by a user located only on the inner side 33 of a temporary fortification 30. In such embodiments, a user does not need to be located on the outer side 32 of a temporary fortification 30 to replace the sensory pane frame 53 and the resistant sensory pane 51, such that the user does not need to be exposed to threats located on the outer side 32 during replacement of the sensory pane frame 53 and the resistant sensory pane 51.

In other embodiments, the resistance devices or fasteners 56 may be any other devices or fasteners that are capable of selectively providing a clamping or fastening force between the sensory pane frame 53 and the resistant panel 41, including devices that permit manual installation and removal of the sensory pane frame 53 with or without the use of tools. For example, the resistance devices or fasteners 56 may be adjustment knobs, standard nuts, a ratcheting mechanism, cotter pins, hinged portions of the sensory pane frame coupling members 45, or any other clamping or fastening mechanism that is known in the art.

In an exemplary embodiment, the sensory pane frame coupling members 45 extend from the inner side 43 of the resistant panel 41 in a direction substantially transverse to the inner side 43. In some embodiments, the sensory pane frame coupling members 45 are stud-welded to the inner side 43 of resistant panel 41, without penetrating through the panel 41. In other embodiments, the sensory pane frame coupling members 45 may penetrate through the resistant panel 41 or may be affixed to the panel 41 using any attachment mechanism known in the art.

The frame assembly 60 includes one or more support assemblies 61 extending from the resistant panel 41 in a direction substantially transverse to the panel 41. Each support assembly 61 includes frame panels 62 that are adapted to support the filling material 31. The frame assembly 60 may further comprise holes 65 and resistance devices or fasteners 66 for coupling the support assemblies 61 to the resistant panel 41. Each support assembly 61 may form a frame aperture 64 that is adapted to provide access to the temporary fortification assembly 40.

In an exemplary embodiment, the frame assembly 60 includes two generally square box-shaped support assemblies 61, a first support assembly 61 attached to a first outer side 42 of the resistant panel 41 and extending from the panel 41 in a first direction substantially transverse to the panel 41, and a second support assembly 61 attached to a second inner side 43 of the panel 41 and extending from the panel 41 in a second direction substantially opposite the first direction. As shown, each support assembly 61 includes four frame panels 62 extending from the resistant panel 41 in a direction substantially transverse to the panel 41. In some embodiments, the frame assembly 60 may include only one support assembly 61. In some embodiments, the temporary fortification assembly 40 may be used without a frame assembly 60. In embodiments without a frame assembly 60, the temporary fortification assembly 40 may be used to add a resistant sensory pane 51 and/or an access port 10 to temporary, semi-permanent, or permanent walled fortifications (not shown). In such embodiments without a frame assembly 60, the threat resistant panel 41 containing the sensory pane 51 and/or the access port 10 may be fitted with brackets or other coupling mechanisms known in the art for placement in the walls of a fortified structure.

The support assemblies 61 may have other box-like shapes, including, for example, rectangular, triangle, trapezoid, hexagon, circle, oval, or any other shape, depending on the desired field of view or sensing and ease of access through the temporary fortification assembly 40. In some embodiments, the support assemblies 61 may have non-box-like shapes, including, for example, L-shaped brackets, two frame panels 62 extending in a direction substantially transverse from the resistant panel 41 at the top and bottom of the panel 41, or any other support mechanism that may help keep the filling material 31 from blocking access to the sensory pane 51 and/or the access port 10.

The support assemblies 61 and the included frame panels 62 may be made from any ballistic-resistant or non-ballistic-resistant material, including steel, aluminum, carbon fiber, a composite material, or any other material suitable for potentially providing some protection to a user on the inner side 33 of the temporary fortification 30 from incoming ballistics and/or for keeping the filling material 31 from blocking access to the sensory pane 51 and/or the access port 10.

Each support assembly 61 is mounted to the resistant panel 41 by coupling the resistance devices 66 to the plurality of frame coupling members 46 that extend in a substantially transverse direction from the panel 41, through the holes 65 in the support assemblies 61. The resistance devices 66 are adapted to selectively adjust resistance between the each support assembly 61 and the respective outer side 42 or the inner side 43 of the resistant panel 41. As shown in the Figures, each support assembly 61 is removably mounted to the resistant panel 41. In other embodiments (not shown), one or both support assemblies 61 may be permanently mounted to the resistant panel 41 (e.g., mounted with the use of welding).

In an exemplary embodiment, the resistance devices 66 are tapped wing nuts that may be screwed onto threaded portions of the frame coupling members 46. In the embodiment shown, the resistance devices 66 may be installed and removed without the use of tools, thereby allowing one or both support assemblies 61 to be manually installed to and removed from the resistant panel 41 without the use of tools.

In other embodiments, the resistance devices or fasteners 66 may be any other devices or fasteners that are capable of selectively providing a clamping or fastening force between each support assembly 61 and the resistant panel 41, including devices that permit manual installation and removal of one or both support assemblies 61 with or without the use of tools. For example, the resistance devices or fasteners 66 may be adjustment knobs, standard nuts, a ratcheting mechanism, cotter pins, hinged portions of the frame coupling members 46, or any other clamping or fastening mechanism that is known in the art.

The frame coupling members 46 extend from both the outer side 42 and the inner side 43 of the resistant panel 41 in respective directions substantially transverse to the resistant panel 41. In an exemplary embodiment, the frame coupling members 46 are stud-welded to the outer side 42 and/or the inner side 43 of resistant panel 41, without penetrating through the panel 41. In other embodiments, the frame coupling members 46 may penetrate through the resistant panel 41 or may be affixed to the panel 41 using any attachment mechanism known in the art.

Exemplary Barriers with Access Ports

Figure 6A:
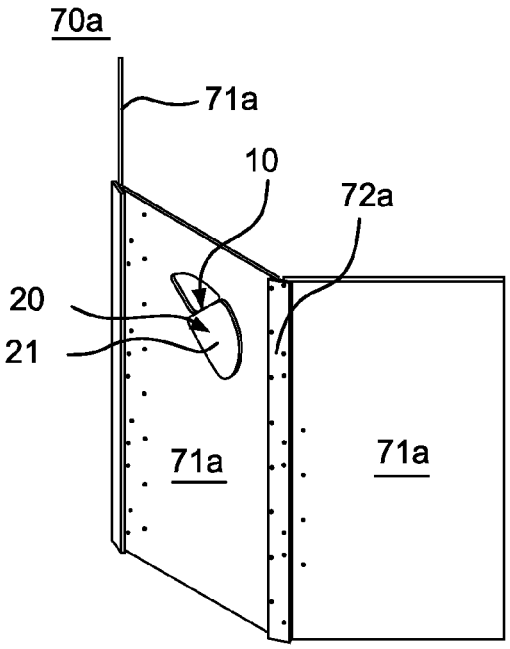
FIG. 6A is a perspective view of an outer side of a threat barrier including an access port.

Referring now to FIG. 6A, an exemplary threat barrier 70*a* includes one or more threat resistant panels 71*a*, one or more interconnecting braces 72*a* for coupling the threat resistant panels 71*a* together, and an access port 10 movably coupled to a panel 71*a* as described above and as shown in FIGS. 1A-2C. The panels 71*a* may be coupled together by use of the interconnecting braces 72*a* to form a partial or complete enclosure. The braces 72*a* may include channels in which the edges of the panels 71*a* may fit, such that successive panels 71*a* may be coupled together by the braces 72*a*, or the interconnecting braces 72*a* may be attached to the panels 71*a* using screws, bolts, stud-welding, or any other coupling mechanism that is known in the art.

In some embodiments, the interconnecting braces 72*a* may include an outer threat resistant panel that may protect the gap between adjacent threat resistant panels 71*a* from incoming ballistics or other safety threats, and an inner mounting panel or bracket for interconnecting adjacent threat resistant panels 71*a* to form a partial or complete enclosure. For example, as shown in FIG. 6E, the interconnecting braces 72*a* include an outer threat resistant panel 75 that may protect the gap between adjacent panels 71*a* from safety threats, and an inner mounting bracket 76 for interconnecting adjacent panels 71*a*.

The inner mounting bracket 76 may include slots 77 that are adapted to allow adjustable coupling of the panels 71*a* to the bracket 76 by inserting connectors 78 through the slots 77 and attaching resistance devices or fasteners 79 onto the connectors 78. The slots 77 may be adapted to allow a first panel 71*a* having a first thickness to be coupled to a second panel 71*a* having a second thickness that is different than the first thickness.

As shown, the resistance devices or fasteners 79 are tapped wing nuts that may be screwed onto threaded portions of the connectors 78. In the embodiment shown, the resistance devices 79 may be installed onto the connectors 78 and removed from the connectors 78 without the use of tools, thereby allowing adjacent panels 71*a* to be manually coupled and uncoupled without the use of tools.

In other embodiments, the resistance devices or fasteners 79 may be any other devices or fasteners that are capable of selectively providing a clamping or fastening force between each panel 71*a* and a respective interconnecting brace 72*a*, including devices that permit manual coupling and removal of each panel 71*a* to a respective interconnecting brace 72*a* with or without the use of tools. For example, the resistance devices or fasteners 79 may be adjustment knobs, standard nuts, a ratcheting mechanism, cotter pins, hinged portions of the connectors 78, or any other clamping or fastening mechanism that is known in the art.

The threat resistant panels 71*a* may serve to protect people or property positioned behind the panels 71*a* from harmful effects of explosion blasts and related shock waves, incoming ammunition, and projectiles such as bullets, missiles, rockets, or any other ballistics or safety threats known in the art. The threat resistant panels 71*a* may serve to resist, deflect or alter the trajectory of, and/or provide a point of impact to detonate any or all such incoming ballistics and/or resist explosive blast shock waves. The threat resistant panels 71*a*, the interconnecting braces 72*a*, and the outer member 21 of the threat resistant cover 20 of the access port 10 may be opaque, translucent, or transparent, and may be made from any resistant material, such as steel, glass, ceramic, Kevlar, fiberglass, a composite material, or any other material that meets standards that are known in the art for ballistic or explosive blast resistance.

Figure 6B:
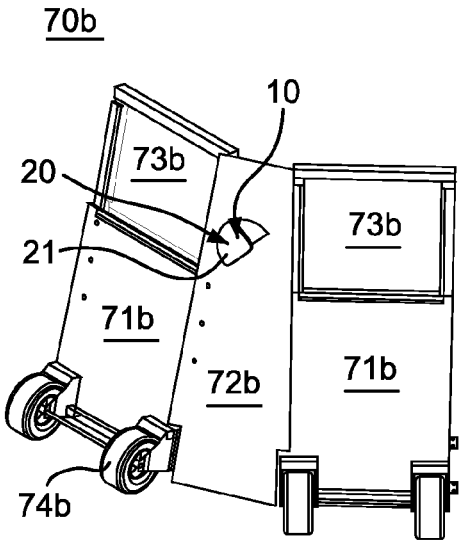
FIG. 6B is a perspective view of an outer side of a second embodiment of a threat barrier including an access port.

Referring now to FIG. 6B, a second embodiment of a threat barrier 70*b* includes one or more threat resistant panels 71*b*, one or more threat resistant interconnecting panels 72*b* for coupling the threat resistant panels 71*b* together, one or more threat resistant sensory pane assemblies 73*b* that allows visual access through the panels 71*b*, a plurality of wheel assemblies 74*b* for transporting the threat barrier 70*b*, and an access port 10 movably coupled to an interconnecting panel 72*b* as described above and as shown in FIGS. 1A-2C.

The resistant panels 71*b* may be coupled together by use of the interconnecting panels 72*b* to form a partial or complete enclosure. The interconnecting panels 72*b* may include channels in which the edges of the panels 71*b* may fit, or the interconnecting panels 72*b* may be attached to the panels 71*b* using nylon ratchet straps, screws, bolts, stud-welding, any other coupling mechanism that is known in the art, or gravity may be used (e.g., sliding edges of the resistant panels 71*b* into channels in the interconnecting panels 72*b* without any additional coupling mechanism. Each threat resistant panel 71*b* may also be the front panel of a kiosk-shaped threat barrier such as that described below and as shown in FIGS. 6C and 6D.

The threat resistant panels 71*b*, the threat resistant interconnecting panels 72*b*, and the threat resistant sensory pane assemblies 73*b* may serve to protect people or property positioned behind the threat barrier 70*b* from harmful effects of explosion blasts and related shock waves, incoming ammunition, and projectiles such as bullets, missiles, rockets, or any other ballistics or safety threats known in the art. The resistant panels 71*b*, the interconnecting panels 72*b*, and the sensory pane assemblies 73*b* may serve to resist, deflect or alter the trajectory of, and/or provide a point of impact to detonate any or all such incoming ballistics and/or resist explosive blast shock waves. The resistant panels 71*b*, the interconnecting panels 72*b*, the sensory pane assemblies 73*b*, and the outer member 21 of the resistant cover 20 of the access port 10 may be opaque, translucent, or transparent, and may be made from any explosive blast or ballistic resistant material, such as steel, glass, ceramic, Kevlar, fiberglass, a composite material, or any other material that meets standards that are known in the art for ballistic or explosive blast resistance. The interconnecting panels 72*b* may made from any resistant material (such as steel or any of the resistant materials mentioned above) or any non-resistant material, such as aluminum, plastic, carbon fiber, or any composite material.

Figure 6C:
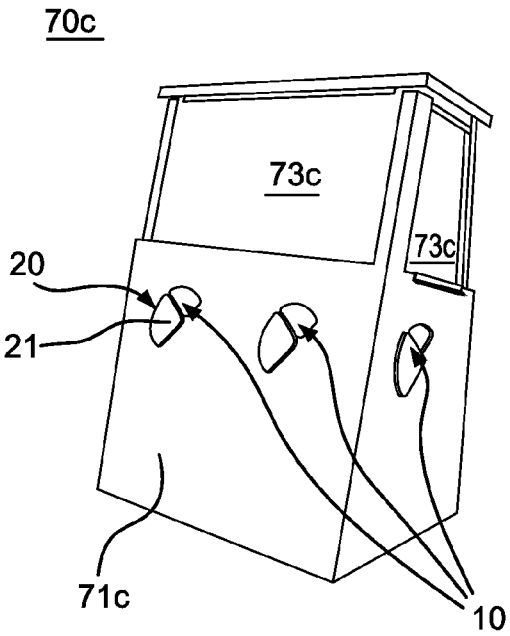
FIG. 6C is a perspective view of an outer side of a third embodiment of a threat barrier including an access port.
Figure 6D:
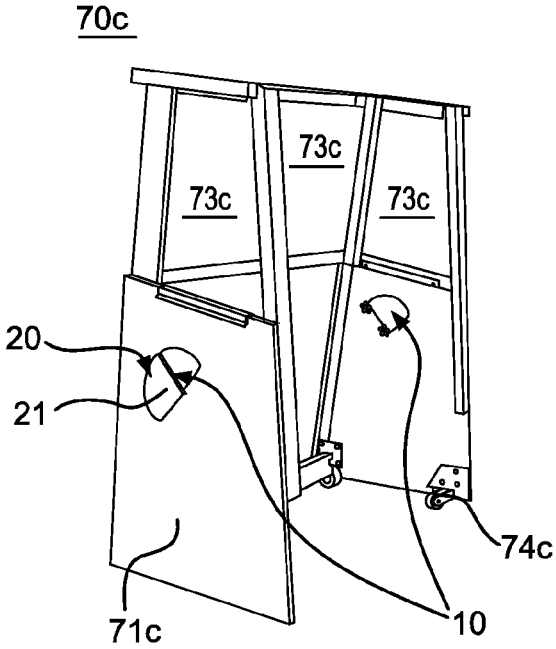
FIG. 6D is a perspective view of an inner side of the threat barrier depicted in FIG. 6C.
Figure 6E:
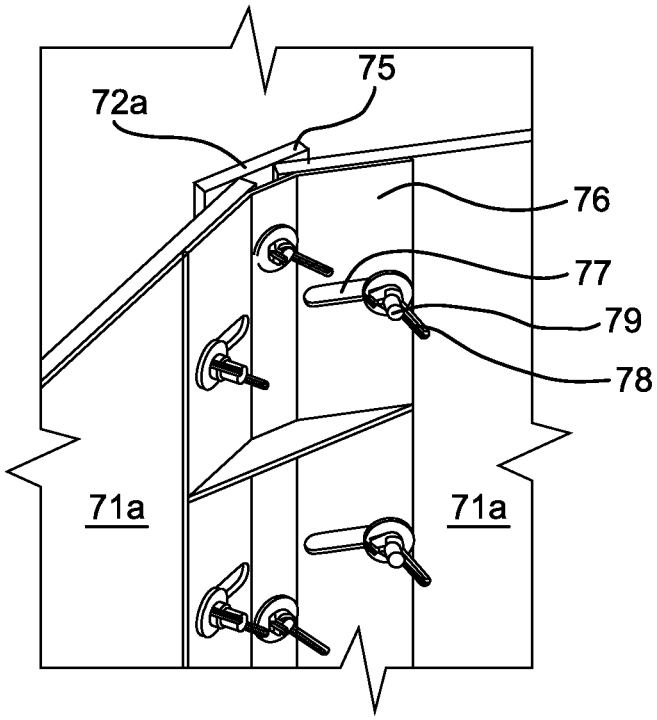
FIG. 6E is a perspective view of an inner side of an interconnecting brace of the threat barrier depicted in FIG. 6A.

Referring now to FIGS. 6C and 6D, a third embodiment of a threat barrier 70*c* includes a plurality of threat resistant panels 71*c* coupled together to form a kiosk-shaped enclosure, a plurality of threat resistant sensory pane assemblies 73*c* that allow visual access through the panels 71*c*, a plurality of wheel assemblies 74*c* for transporting the threat barrier 70*c*, and one or more access ports 10 movably coupled to one or more threat resistant panels 71*c* as described above and as shown in FIGS. 1A-2C.

The resistant panels 71*c* and the sensory pane assemblies 73*c* may serve to protect people or property positioned behind the threat barrier 70*c* from harmful effects of explosion blasts and related shock waves, incoming ammunition, and projectiles such as bullets, missiles, rockets, or any other ballistics or safety threats known in the art. The resistant panels 71*c* and the sensory pane assemblies 73*c* may serve to resist, deflect or alter the trajectory of, and/or provide a point of impact to detonate any or all such incoming ballistics and/or resist explosive blast shock waves. The threat resistant panels 71*c*, the threat resistant sensory pane assemblies 73*c*, and the outer member 21 of the resistant cover 20 of the access ports 10 may be opaque, translucent, or transparent, and may be made from any explosive blast or ballistic resistant material, such as steel, glass, ceramic, Kevlar, fiberglass, a composite material, or any other material that meets standards that are known in the art for ballistic or explosive blast resistance.

Figure 7:
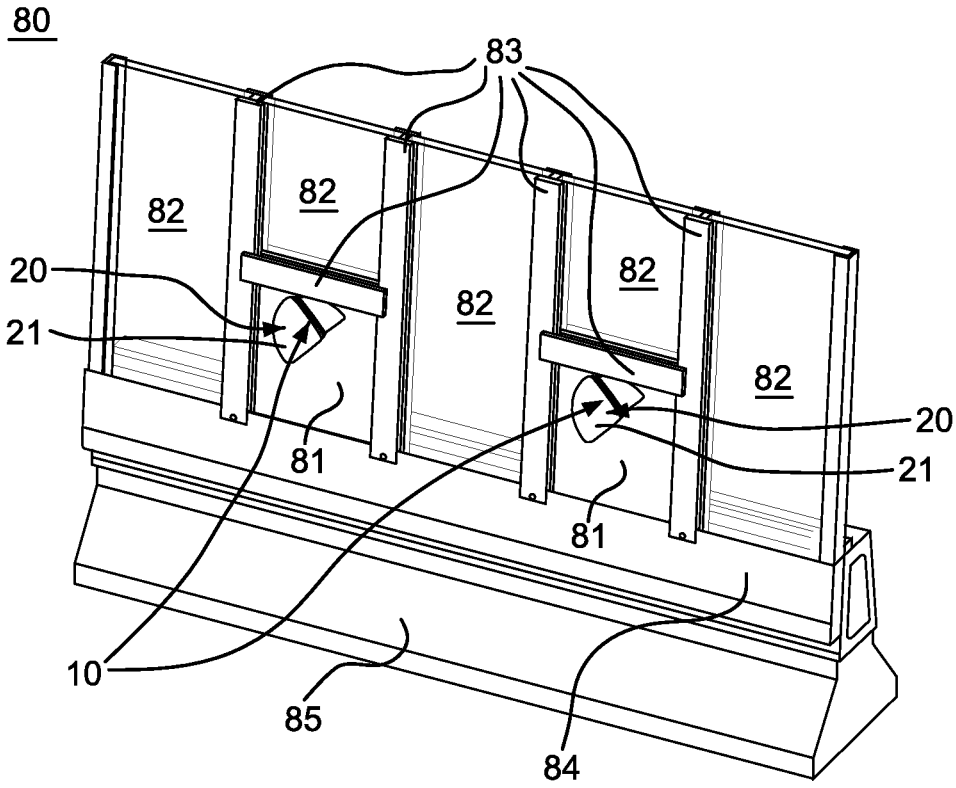
FIG. 7 is a perspective view of an outer side of a fourth embodiment of a threat barrier including an access port.

Referring now to FIG. 7, a fourth embodiment of a threat barrier 80 includes one or more threat resistant panels 81, one or more threat resistant sensory pane assemblies 82 that allow visual access through the threat barrier 80, one or more threat resistant interconnecting braces 83 for coupling the panels 81 and the sensory pane assemblies 82 together, a concrete barrier cap 84 located at the bottom of the threat barrier 80 and configured to allow barrier 80 to be placed on the top portion of a concrete barrier 85, and one or more access ports 10 movably coupled to one or more threat resistant panels 81 as described above and as shown in FIGS. 1A-2C.

The resistant panels 81 and the sensory pane assemblies 82 may be coupled together by use of the interconnecting braces 83 to form a wall-like threat barrier 80. The interconnecting braces 83 may include channels in which the edges of the panels 81 and sensory pane assemblies 82 may fit, or the interconnecting braces 83 may be attached to the panels 81 and the sensory pane assemblies 82 using screws, bolts, stud-welding, any other coupling mechanism that is known in the art, or gravity may be used (e.g., sliding edges of the resistant panels 81 and the sensory pane assemblies 82 into channels in the interconnecting braces 83 without any additional coupling mechanism.

The threat resistant panels 81, the sensory pane assemblies 82, the interconnecting braces 83, the concrete barrier cap 84, and the concrete barrier 85 may serve to protect people or property positioned behind the threat barrier 80 from harmful effects of explosion blasts and related shock waves, incoming vehicle impact, incoming ammunition, and projectiles such as bullets, missiles, rockets, or any other ballistics or safety threats known in the art. The threat resistant panels 81, sensory pane assemblies 82, the interconnecting braces 83, the concrete barrier cap 84, and the concrete barrier 85 may serve to resist, deflect or alter the trajectory of, and/or provide a point of impact to detonate any or all such incoming ballistics and/or resist explosive blast shock waves. The resistant panels 81, sensory pane assemblies 82, the interconnecting braces 83, the concrete barrier cap 84, and the outer member 21 of the resistant cover 20 of the access port 10 may be opaque, translucent, or transparent, and may be made from any explosive blast or ballistic resistant material, such as steel, glass, ceramic, Kevlar, fiberglass, a composite material, or any other material that meets standards that are known in the art for ballistic or explosive blast resistance.

In some embodiments, the threat barriers 70*a*, 70*b*, 70*c*, and 80 may be mobile or transportable (e.g., non-permanently placed on the ground, non-permanently attached to another structure, or easily moveable by a person or machine). In some embodiments, the threat barriers 70*a*, 70*b*, 70*c*, and 80 may be non-mobile or non-transportable (e.g., permanently placed on the ground, permanently attached to another structure, or not easily moveable by a person or machine).

The foregoing description is provided for the purpose of explanation and is not to be construed as limiting the potential embodiments. While the embodiments have been described with reference to preferred embodiments or preferred methods, it is understood that the words which have been used herein are words of description and illustration, rather than words of limitation. Furthermore, although the invention has been described herein with reference to particular structure, methods, and embodiments, the potential embodiments are not intended to be limited to the particulars disclosed herein, as the potential embodiments extend to all structures, methods and uses that are within the scope of the appended claims. Further, several advantages have been described that flow from the structure and methods; the potential embodiments are not limited to structure and methods that encompass any or all of these advantages. Those skilled in the relevant art, having the benefit of the teachings of this specification, may effect numerous modifications to the potential embodiments as described herein, and changes can be made without departing from the scope and spirit of the potential embodiments as defined by the appended claims. Furthermore, any features of one described embodiment can be applicable to the other embodiments described herein.

What is claimed:

1. A threat resistant access port, comprising:

a resistant panel having an outer side and an inner side that is opposite the outer side, the resistant panel including an access aperture extending from the outer side to the inner side; and a resistant cover configured to be coupled to the resistant panel, such that the resistant cover is pivotally slidable relative to the resistant panel so as to cover the aperture in a closed position and to uncover at least a portion of the aperture in an open position, the resistant cover comprising:

a first member including an outer surface that is threat resistant and an inner surface opposite the outer surface, the inner surface facing the outer side of the resistant panel when the resistant cover is coupled to the resistant panel and the resistant cover is in both the open position and the closed position; and a second member configured to be coupled to the inner surface of the first member such that the second member and the first member are both pivotally slidable relative to the resistant panel as the resistant cover is moved from the open position to the closed position, the second member extending from the inner surface of the first member through the access aperture when the resistant cover is coupled to the resistant panel.

2. The threat resistant access port of claim 1, further comprising a pivot member configured to pivotally couple the resistant cover to the resistant panel.

3. The threat resistant access port of claim 2, wherein the pivot member defines a pivot axis, and the resistant panel is pivotable about the pivot axis relative to the resistant cover.

4. The threat resistant access port of claim 3, wherein the pivot axis is substantially perpendicular to the outer surface of the first member.

5. The threat resistant access port of claim 3, wherein the resistant panel comprises a panel outer surface that at least partially defines the outer side, and the pivot axis is substantially perpendicular to the panel outer surface.

6. The threat resistant access port of claim 1, wherein the second member comprises a post that extends through the access aperture when the cover is in both the open position and the closed position.

7. The threat resistant access port of claim 1, wherein the resistant panel comprises a first side wall and a second side wall facing the first side wall, the first side wall defining a first edge of the access aperture, and the second side wall defining a second edge of the access aperture.

8. The threat resistant access port of claim 7, wherein the second member abuts the first side wall when the resistant cover is in the open position.

9. The threat resistant access port of claim 8, wherein the second member abuts the second side wall when the resistant cover is in the closed position.

10. The threat resistant access port of claim 1, wherein the second member is coupled to the inner surface of the first member such that the second member is elongate in a direction extending away from the inner surface of the first member.

11. The threat resistant access port of claim 10, wherein the direction is substantially normal to the inner surface of the first member.

12. A threat resistant access port, comprising:

a resistant panel having an outer side and an inner side that is opposite the outer side, the panel including an access aperture extending from the outer side to the inner side; and a resistant cover configured to be coupled to the panel, such that the cover is pivotally slidable relative to the panel so as to cover the aperture in a closed position and to uncover at least a portion of the aperture in an open position, the resistant cover comprising:

a first member including an outer surface that is threat resistant and an inner surface opposite the outer surface, the outer surface facing the inner side of the panel when the cover is coupled to the panel and the cover is in both the open position and the closed position; and a second member coupled to the inner surface of the first member such that the second member and first member are both pivotally slidable relative to the panel as the cover is moved from the open position to the closed position; and a pivot member configured to pivotally couple the cover to the panel.

13. The threat resistant access port of claim 12, wherein the pivot member defines a pivot axis, and the resistant cover is pivotable about the pivot axis relative to the resistant panel.

14. The threat resistant access port of claim 13, wherein the pivot axis is substantially perpendicular to the outer surface of the resistant cover.

15. The threat resistant access port of claim 14, wherein the resistant panel comprises a panel outer surface that at least partially defines the outer side, and the pivot axis is substantially perpendicular to the panel outer surface.

16. A threat resistant fortification assembly, comprising:

a resistant panel including a first side and a second side, the resistant panel defining a sensing aperture extending through the resistant panel from the first side to the second side;

a resistant sensory pane configured to be positioned over at least a portion of the sensing aperture; and a sensory pane frame configured to be mounted to the resistant panel, the sensory pane frame configured to secure the resistant sensory pane in a position over at least a portion of the sensing aperture; and a threat resistant access port including:

an access aperture formed in the panel; and a resistant cover configured to be movably coupled to the panel, the cover being pivotally slidable relative to the panel so as to cover the aperture in a closed position and to uncover at least a portion of the aperture in an open position, the cover including:

a threat resistant first member configured to be located on a first side of the resistant panel, the first member being larger than the access aperture such that when in the closed position the first member partially overlaps the first side of the panel; and a second member coupled to the first member such that the second member extends away from the first member in a direction.

17. The threat resistant fortification assembly of claim 16, further comprising a pivot member configured to pivotally couple the resistant cover to the resistant panel.

18. The threat resistant fortification assembly of claim 17, wherein the pivot member defines a pivot axis, and the resistant panel is pivotable about the pivot axis relative to the resistant cover.

19. The threat resistant fortification assembly of claim 18, wherein the first member comprises an inner surface facing the first side of the resistant panel, and the first member comprises an outer surface opposite the inner surface, and the pivot axis is substantially perpendicular to the outer surface of the first member.

20. The threat resistant fortification assembly of claim 18, wherein the resistant panel comprises a panel outer surface that at least partially defines the first side, and the pivot axis is substantially perpendicular to the panel outer surface.

21. The threat resistant fortification assembly of claim 16, wherein the second member comprises a post that extends through the access aperture when the resistant cover is in both the open position and the closed position.

22. The threat resistant fortification assembly of claim 16, wherein the resistant panel comprises a first side wall, and a second side wall facing the first side wall, the first side wall defining a first edge of the access aperture, and the second side wall defining a second edge of the access aperture.

23. The threat resistant fortification assembly of claim 22, wherein the second member abuts the first side wall when the resistant cover is in the open position.

24. The threat resistant fortification assembly of claim 23, wherein the second member abuts the second side wall when the resistant cover is in the closed position.

25. A barrier, comprising:

a resistant panel including an outer side and an inner side that is opposite the outer side, the outer side extending substantially in a first plane; and a resistant access port comprising:

an access aperture extending through the resistant panel from the inner side to the outer side; and a resistant cover movably coupled to the panel, the cover being pivotally slidable relative to the panel in a plane substantially parallel to the first plane so as to cover the aperture in a closed position and to uncover at least a portion of the aperture in an open position, the resistant cover comprising:

a resistant first member including an inner surface and an outer surface that is opposite the inner surface, the resistant first member configured to be located adjacent the outer side of the resistant panel such that the inner surface faces the outer side; and a second member coupled to the first member.

26. The barrier of claim 25, wherein the second member is coupled to the inner surface of the first member such that the second member and first member are both pivotally slidable relative to the resistant panel as the resistant cover is moved from the open position to the closed position, and the second member extends from the inner surface of the first member through the access aperture when the resistant cover is coupled to the resistant panel.

27. The barrier of claim 26, wherein the second member is elongate in a direction substantially normal to the inner surface of the first member.

28. The barrier of claim 25, further comprising a pivot member configured to pivotally couple the resistant cover to the resistant panel, and the pivot member defines a pivot axis that the resistant panel is pivotable about relative to the resistant cover.

29. The barrier of claim 28, wherein the pivot axis is substantially perpendicular to the first plane.

30. The barrier of claim 25, wherein the resistant panel comprises a first side wall and a second side wall facing the first side wall, the first side wall defining a first edge of the access aperture, and the second side wall defining a second edge of the access aperture.

31. The barrier of claim 30, wherein the second member abuts the first side wall when the resistant cover is in the open position.

32. The barrier of claim 31, wherein the second member abuts the second side wall when the resistant cover is in the closed position.

* * * * *